US009586339B2

(12) United States Patent
Maurer et al.

(10) Patent No.: US 9,586,339 B2
(45) Date of Patent: Mar. 7, 2017

(54) PROCESS FOR PREPARING CERAMIC BODIES

(75) Inventors: Myron J. Maurer, Saginaw, MI (US); Joshua R. Weyburne, Walnut Creek, CA (US)

(73) Assignee: Dow Global Technologies LLC, Midland, MI (US)

( * ) Notice: Subject to any disclaimer, the term of this patent is extended or adjusted under 35 U.S.C. 154(b) by 340 days.

(21) Appl. No.: 14/127,076

(22) PCT Filed: Aug. 23, 2012

(86) PCT No.: PCT/US2012/051971

§ 371 (c)(1),
(2), (4) Date: Dec. 17, 2013

(87) PCT Pub. No.: WO2013/032831

PCT Pub. Date: Mar. 7, 2013

(65) Prior Publication Data

US 2014/0159265 A1 Jun. 12, 2014

Related U.S. Application Data

(60) Provisional application No. 61/527,846, filed on Aug. 26, 2011.

(51) Int. Cl.

| | |
|---|---|
| ***B28B 13/02*** | (2006.01) |
| ***B28B 11/00*** | (2006.01) |
| ***B28B 17/00*** | (2006.01) |

(52) U.S. Cl.

CPC ..... *B28B 13/0295* (2013.01); *B28B 11/005* (2013.01); *B28B 17/0072* (2013.01)

(58) Field of Classification Search

CPC ..... B28B 13/0295; B28B 2003/203; B28B 3/269

See application file for complete search history.

(56) References Cited

U.S. PATENT DOCUMENTS

| | | | |
|---|---|---|---|
| 3,899,326 | A | 8/1975 | Frost et al. |
| 4,001,028 | A | 1/1977 | Frost et al. |

(Continued)

FOREIGN PATENT DOCUMENTS

| | | | |
|---|---|---|---|
| DE | 7339647 | U | 4/1974 |
| EP | 1142619 | B1 | 1/2007 |

(Continued)

OTHER PUBLICATIONS

Reed, J., Ceramic Processing, Wiley Interscience, 1988, Chapters 20 and 21.

(Continued)

*Primary Examiner* — Stella Yi

(74) *Attorney, Agent, or Firm* — The Dobrusin Law Firm, P.C.; Norman L. Sims

(57) ABSTRACT

A method comprising: a) determining the bow (28) in the extension direction of one or more linear paths on an outer surface or outer surfaces (11,13,14,16) of an extruded ceramic part (10) so that maximum extrusion direction bow (28) of the one of more linear paths or outer surfaces (11,13,14,16) may be determined of the extruded ceramic greenware part (10); b) identifying the linear path on the outer surface or the outer surfaces (11,13,14,16) having maximum convex bow; c) placing the greenware part (10) on a carrier with the linear path on the outer surface or the outer surface location having the maximum convex shape in contact with the carrier; and d) processing the greenware part (10) while disposed on the carrier with the linear path on the outer surface or the surface having the convex shape on the carrier, such that the bow (28) is reduced as a result of the process.

20 Claims, 4 Drawing Sheets

(56) References Cited

U.S. PATENT DOCUMENTS

| | | | | |
|---|---|---|---|---|
| 4,162,285 | A | 7/1979 | Tanabashi | |
| 4,329,162 | A | 5/1982 | Pitcher, Jr. | |
| 4,741,792 | A | 5/1988 | Matsuhisa et al. | |
| 4,786,542 | A | 11/1988 | Yasuda et al. | |
| 4,837,943 | A | 6/1989 | Mizutani | |
| 4,948,766 | A | 8/1990 | Talmy et al. | |
| 5,173,349 | A | 12/1992 | Yavuz et al. | |
| 5,435,877 | A | 7/1995 | Ishii et al. | |
| 5,538,681 | A | 7/1996 | Wu | |
| 5,589,725 | A | 12/1996 | Haertling | |
| 5,914,187 | A | 6/1999 | Naruse et al. | |
| 6,582,796 | B1 | 6/2003 | Joulin et al. | |
| 6,596,666 | B1 | 7/2003 | Yamada | |
| 6,669,751 | B1 | 12/2003 | Ohno et al. | |
| 6,797,666 | B2 | 9/2004 | Harada et al. | |
| 6,953,554 | B2 | 10/2005 | Wallin et al. | |
| 7,396,576 | B2 | 7/2008 | Masukawa et al. | |
| 7,485,594 | B2 | 2/2009 | Saha et al. | |
| 7,879,428 | B2 | 2/2011 | Ohno et al. | |
| 2003/0057592 | A1* | 3/2003 | Grover | B28B 3/20 264/177.12 |
| 2004/0020359 | A1 | 2/2004 | Koermer et al. | |
| 2008/0271422 | A1 | 11/2008 | Zawisza | |
| 2009/0239030 | A1 | 9/2009 | Cai et al. | |
| 2012/0001358 | A1 | 1/2012 | Clark et al. | |

FOREIGN PATENT DOCUMENTS

| | | | |
|---|---|---|---|
| EP | 1604719 | B1 | 7/2008 |
| EP | 1974884 | B1 | 10/2012 |
| WO | 2003051488 | A1 | 6/2003 |
| WO | 2004011124 | A1 | 2/2004 |
| WO | 2004011386 | A1 | 2/2004 |

OTHER PUBLICATIONS

Gerhaher, F., et al., DE7339647-U, Apr. 18, 1974, (Machine Translation).

Reed, J., Introduction to the Principles of Ceramic Processing, John Wiley and Sons, NY, 1988, Chapters 20-21, Parts 1 and 2, pp. 329-372 and 373-379.

* cited by examiner

PROCESS FOR PREPARING CERAMIC BODIES

CLAIM OF PRIORITY

This application claims priority from provisional application Ser. No. 61/527,846 filed Aug. 26, 2011 incorporated herein by reference in its entirety.

FIELD OF THE INVENTION

The present invention relates generally to a method of preparing ceramic bodies with improved shape profile and to filters prepared from the ceramic bodies. The present invention further relates generally to a method of preparing ceramic bodies having improved performance and to filters prepared by the process.

BACKGROUND TO THE INVENTION

Diesel and gasoline engines emit soot particles, very fine particles of carbon and soluble organics as well as typical harmful engine exhaust gases (i.e., HC, CO and NOx). Regulations have been enacted curbing the amount of soot permitted to be emitted. To meet these challenges, soot filters have been used. The filters must be periodically regenerated by burning off the soot, which results in stresses from axial and radial temperature gradients that can cause cracking of the filter due to stresses caused by the differential temperatures along with the coefficient of thermal expansion of the filter material.

To overcome stresses, ceramic honeycombs, such as catalytic converters, heat exchangers and filters, smaller honeycomb segments are assembled into arrays of segments to form larger honeycomb structure (segmented substrates). Cement layers between the honeycombs have been used, for example, to increase the thermal conductivity to reduce the ultimate temperature reached in the assembled honeycomb such as described by U.S. Pat. No. 6,669,751, incorporated herein by reference. To achieve the improved thermal conductivity, these cements/sealing layers/adhesives have used ceramic particulates to increase the thermal mass/conductivity and ease of application to the smaller honeycomb segments. Often such cements are augmented by the use of ceramic fibers, and ceramic binders and organic binders such as described by U.S. Pat. No. 5,914,187, incorporated herein by reference, to facilitates application of the cement prior to firing (e.g., reduce segregation of particulates) and improve some mechanical properties such as toughness of the cement.

The honeycomb segments that are assembled to prepare these filters do not have perfectly straight surfaces and are not completely flat. When the surfaces bonded together have too much variation of straightness or flatness along the surface, the cement used to bond the surfaces of the honeycomb segments together needs to be thicker than when the surfaces are relatively flat and straight. Thick layers of cement can have deleterious effects on the assembled honeycombs, for instance the backpressure is increased and the thermal stability is decreased. It is known to measure the flatness of segment surfaces see U.S. Pat. No. 6,596,666 and U.S. Pat. No. 7,879,428, incorporated herein by reference, which cite JISB0621-1984 as a test method for measuring flatness. Flatness is generally measured by defining two parallel planes. One plane is defined by the innermost surface of a face of a honeycomb segment, toward the center of the honeycomb segment (least square fit plane of measured points) and the second plane is defined by the outermost surface of the same face of a honeycomb segment. The distance, computed as the difference between outer minus inner, between the planes is known as the flatness and is by definition always positive. Lower flatness numbers are considered better. As a practical matter the surface is mapped by taking several data points (e.g., y and z) and a least square fit plane is calculated mathematically based on the population of points. In production, finished segments are measured for flatness and if a segment has a side which has a flatness which is above the acceptable limit the segment is rejected or scrapped. The scrapping of a significant number of segments adds undesirable costs.

Processes for the preparation of ceramic bodies can result in a number of parts having along a line or a surface, a curved profile (bow). This curved profile may present problems with the use of the ceramic body in the intended use. Where the ceramic body is used to prepare larger ceramic arrays, such curved profiles (i.e. not straight or not flat) may result in the part not being suitable for assembly into a larger array or require too much cement to properly bond the part to other parts.

What is needed is a process for preparing extruded ceramic bodies without a significant number of units that have unacceptable bow. What is needed is a method of preparing segmented ceramic parts having improved flow (e.g. lower back pressure); improved thermal shock resistance and which is more efficient than processes known in the art (e.g. which has a higher rate of segment utilization or lower rate of segment rejection). What is needed is a method of identifying segments that have unacceptable bow or flatness and of repairing the bow or flatness to thereby reduce the scrap rate of production and to enhance the properties of the ceramic bodies and assemblies of ceramic bodies.

SUMMARY OF THE INVENTION

The present invention is a method comprising: a) determining the bow in the extrusion direction of one or more linear paths on an outer surface or outer surfaces of an extruded ceramic part so that maximum extrusion direction bow of the one or more linear paths or outer surfaces of the extruded ceramic greenware part may be determined; b) identifying the linear path on the outer surface or the outer surface having maximum convex bow; c) placing the greenware part on a carrier with the linear path on the outer surface or the outer surface location having the maximum convex shape in contact with the carrier; and d) processing the greenware part while disposed on the carrier with the linear path on the outer surface or the surface having the convex shape on the carrier, such, that the bow is reduced as a result of the process.

Another embodiment of the invention is a method comprising: a) identifying a number of points of one or more linear paths of the outer surface or of outer surfaces (e.g. flat sides) of an extruded ceramic greenware part having one or more linear paths of the outer surface or of outer surfaces (flat sides); b) identifying a linear path or surface (side) with a convex shape; c) placing the greenware part on a carrier with the linear path or surface (side) having the convex shape on the carrier; and d) converting the greenware part to a ceramic part while disposed on the carrier with the linear path or surface (side) having the convex shape on the carrier and in contact with the carrier; wherein the resulting ceramic part has reduced how or flatness of at least one of the linear paths of the outer surface or outer surfaces (e.g. flat sides).

In a preferred embodiment the flatness of one or more flat sides of a ceramic part is determined. Preferably one or more of the flat sides of a ceramic part after the process of the invention is from about 0 to about 3.0 mm. Preferably the bow of the linear path of the outer surface or the flat side of the outer surface is about 2.0 mm or less and more preferably about 1.0 mm or less. Linear path as used means a line along an outer surface of an extruded greenware part, preferably running in the extrusion direction. Preferably the carrier is a conveyor rack, or plate on a conveyor and the carrier is adapted to support the part through the process operations to form the part into a ceramic part. In one embodiment one or more of the surfaces of the ceramic part are cemented to one or more other ceramic parts with matching surfaces. Preferably such matching surfaces are flat surfaces. Preferably the ceramic parts, segments, have a plurality of flat sides (surfaces). Preferably, one or more of the liner paths and/or surfaces is mapped, and the results of the mapping are used to calculate the now and/or flatness the mapped linear paths or surfaces. Preferably, one of the surfaces of the greenware part is marked with a reference marking to facilitate identification of all of the surfaces (sides) of the greenware part. Preferably, the resulting flatness of all of the sides (surfaces) is from about 0 to 3.0 mm. Preferably the bow of all flat surfaces or linear paths in the extrusion direction is about 0 to about 2.0 mm.

The invention provides a method for preparing extruded ceramic parts having acceptable bow and/or flatness. The method allows correction of parts with unacceptable bow and or flatness. The method of the invention for preparing ceramic parts provides for the preparation of segmented ceramic parts having improved, flow (e.g., lower back pressure); improved thermal performance, and the process is more efficient than processes known in the art (e.g. has a higher rate of segment utilization or lower rate of segment rejection). The method identifies segments that have unacceptable bow and/or flatness and allows repairing the bow and/or flatness to thereby reduce the scrap rate of production and to enhance the performance of the assembled ceramic parts. Preferably the method of the invention results in the bow, and/or flatness number of the linear path or flat side having a convex shape being reduced by about 25 percent or greater. Preferably, the acceptance rate of the production of a plurality of ceramic parts is increased by 10 percent over other production processes.

DETAILED DESCRIPTION

Figure 1:
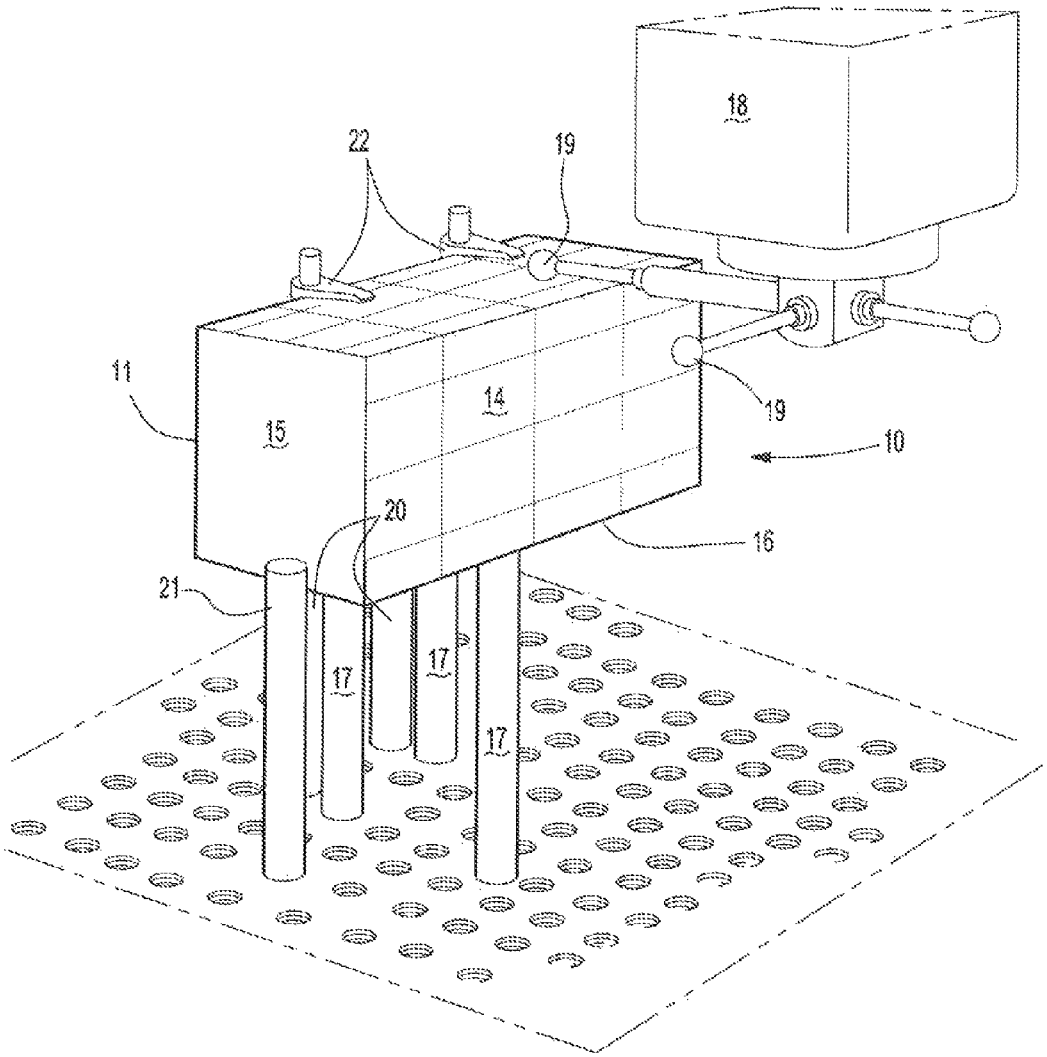
FIG. 1 shows a ceramic segment in a system for measuring the segment surfaces.

The explanations and illustrations presented herein are intended to acquaint others skilled in the art with the invention, its principles, and its practical application. Those skilled in the art may adapt and apply the invention in its numerous forms, as may be best suited to the requirements of a particular use. The specific embodiments of the present invention as set forth are not intended as being exhaustive or limiting of the invention. The scope of the invention should be determined not with reference to the above description and instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present invention relates to an improved process for the preparation of ceramic products wherein the percentage of such products having acceptable bow (straightness) and/or flatness is increased and where a significant portion of ceramic greenware having unacceptable bow and/or flatness can be corrected as a result of the process. In another embodiment, the present invention relates to an improved process for the preparation of ceramic products having on their outer surfaces linear paths or flat surfaces (sides) wherein the percentage of such products having acceptable bow and/or flatness is increased and where a significant portion of ceramic greenware having unacceptable bow and/or flatness can be corrected as a result of the process. The process generally comprises: determining the bow of one or more: linear paths or flat surfaces on the outer surface of an extruded ceramic greenware honeycomb part having one or more linear paths or flat surfaces on its outer surface; b) identifying a linear path or surface with a convex shape; c) placing the greenware pant on a carrier with the linear path or surface having the convex shape on the carrier; and d) converting the greenware par to a ceramic part while disposed on the carrier with the linear path or surface having the convex shape on the carrier and in contact with the carrier. Ceramic greenware utilized in this process is a precursor to a ceramic part having a near net shape and wherein the part has been mostly dried, that is where a large portion or substantially all of the liquid carrier mixed with the ceramic precursors, giving the mixture used to form the desired shape of the ceramic part, is removed. Substantially removed, as used in the context of removal of the liquid carrier from the wet ceramic greenware, means that the greenware can be subjected to removal of the binder and formation of the ceramic structure without the liquid carrier interfering in the process. In this context, substantially removed means that about 10 percent by weight or less of liquid carrier is retained in the dried ceramic greenware body and more preferably about 5 percent by weight or less. Bow as used herein means a deviation from flatness or straightness along the length and/or width dimensions of a ceramic body. Straightness with respect to a linear path refers to the property of a line on the surface of a ceramic greenware body related to how much it deviates from a perfectly straight line. Preferably this linear path is disposed in the direction of extrusion of the ceramic body.

The honeycomb may be formed by any suitable process such as those known in the art, the most common being extrusion of a ceramic plastic mass comprised of ceramic particulates and extrusion additives and liquids to make the mass plastic and to bond the particulates. The extruded honeycomb is then typically dried of carrier liquids, organic additives such as lubricants, binders and surfactants are removed by heating and further subjected to heating such that the ceramic particulates fuse or sinter together or create new particulates that subsequently fuse together. Such methods are described by numerous patents and open literature with the following merely being a small representative sample of U.S. Pat. Nos. 4,329,162; 4,741,792; 4,001,028; 4,162,285; 3,899,326; 4,786,542; 4,837,943 and 5,538,681, all incorporated herein by reference.

Ceramic parts are generally prepared by contacting one or more precursors for the ceramic structure, ceramic precursors, optionally one or more binders and one or more liquid carriers. The ceramic precursors are the reactants or components which when exposed to certain conditions form a ceramic body or part. Any known ceramic precursors may be utilized in the formation of wet ceramic greenware bodies and ultimately ceramic bodies derived form the method of the invention. Included in ceramic precursors are the precursors utilized to prepare one or more of mullite (such as disclosed in U.S. Pat. No. 7,485,594; U.S. Pat. No. 6,953,554; U.S. Pat. No. 4,948,766 and U.S. Pat. No. 5,173,349 all incorporated herein by reference), silicon carbide, cordierite, aluminum titanate, alumina, zirconia, silicon nitride aluminum nitride, silicon oxynitride, silicon carbonitride beta spodumene, strontium aluminum silicates, lithium aluminum silicates, composites of mullite and cordierite and the like. Preferred porous ceramic bodies include mullite, silicon carbide, aluminum titanate, cordierite, and compositions containing ceramind binders and ceramic fibers, mullite, composites of mullite and cordierite or combination thereof. Preferred silicon carbides are described in U.S. Pat. Nos. 6,582,796, 6,669,751B1 and WO Publications EP1142619A1, WO 2002/070106A1. Other suitable porous bodies are described by WO 2004/011386A1, WO 2004/011124A1, US 2004/0020359A1 and WO 2003/051488A1, all incorporated herein by reference. Organic binders useful in this invention include any known materials which render the wet ceramic greenware shapeable. Preferably, the binders are organic materials that decompose or burn at temperatures below the temperature wherein the ceramic precursors react to form ceramic bodies or parts. Among preferred binders are those described in *Introduction to the Principles of Ceramic Processing*, J. Reed, Wiley Interscience, 1988) incorporated herein by reference. A particularly preferred binder is methyl cellulose (such as METHOCEL A5LV methyl cellulose, The Dow Chemical Co., Midland, Mich.). Liquid carriers include any liquid that facilitates formation of a shapeable wet ceramic mixture. Among preferred liquid carriers (dispersants) are those materials described in *Introduction to the Principles of Ceramic Processing*, J. Reed, Wiley Interscience, 1988). A particularly preferred liquid carrier is water. The mixture useful in preparing wet ceramic greenware bodies may be made by any suitable method such as those known in the art. Examples include ball milling, ribbon blending, vertical screw mixing, V-blending and attrition milling. The mixture may be prepared dry (i.e., in the absence of a liquid carrier) or wet. Where the mixture is prepared in the absence of a liquid carrier, a liquid carrier is added subsequently utilizing any of the methods described in this paragraph.

The mixture of ceramic precursors, optionally binders, and liquid carriers may be shaped by any means known in the art. Examples include injection molding, extrusion, isostatic pressing, slip casting, roll compaction and tape casting. Each of these is described in more detail in *Introduction to the Principles of Ceramic Processing*, J. Reed, Chapters 20 and 21, Wiley Interscience, 1988, incorporated herein by reference. In a preferred embodiment the mixture is shaped into the near net shape and size of the ultimate desired ceramic body, such as a flow through filter. Near net shape and size means the size of the wet ceramic greenware body is within 10 percent by volume of the size of the final ceramic body, and preferably the size and shape is within 5 percent by volume of size of the final ceramic body. In one preferred embodiment the ceramic structures comprise a honeycomb structure. Preferably the honeycomb structure is disposed in planes perpendicular to the extrusion direction. In use, each channel formed is plugged at one end or the other. On a face the channels are plugged in an alternating fashion. Preferably the wet ceramic greenware body does not have any of the channels or flow passages blocked or plugged. In practicing the invention, the porous ceramic honeycomb as well as the plugs (note, the plugs may be the same or a different ceramic than the honeycomb as well as may simply be the partition walls of the honeycomb pinched together to close off a channel) may be any suitable ceramic or combinations of ceramics.

In a preferred embodiment, the wet ceramic greenware body is shaped such that it can be utilized as a flow through filter. At this stage in the process the wet ceramic greenware body has two opposing faces which are substantially planar. The wet ceramic greenware body exhibits a cross sectional shape which is consistent for all planes parallel to the two opposing faces. The cross-sectional shape can be any shape which is suitable for the intended use and may be irregular or may be of any known shape, such as round, oval or polygonal. Preferably the cross sectional shape exhibits a flat surface capable of supporting the ceramic body. Preferably the cross-sectional shape is polygonal. In one preferred embodiment, the shape is rectangular or square, if the shape is irregular, it must have at least one linear path or one surface that is planar such that the wet ceramic body can be disposed on the carrier on the linear path or planar surface. The wet ceramic greenware body has a plurality of walls formed which extend from one opposing face to the other opposing face. The walls form a plurality of flow passages that extend from one opposing face to the other opposing face. Preferably, at this stage; all of the flow passages are open to both opposing faces. This allows more efficient removal of liquid carrier.

Thereafter the wet ceramic greenware body is subjected to conditions to remove the liquid carrier, that is to dry the wet ceramic greenware body. The wet ceramic greenware body is placed on a carrying structure while it is subjected to the liquid carrier removal conditions. The carrying structure performs the function of supporting the wet ceramic greenware body through the liquid carrier removal process. Additionally, the carrying structure performs one or more of the following functions: preventing the part of the wet ceramic greenware body in contact with the carrying structure from deforming (that is increasing the bow of a linear path or flat surface or deviation of a flat surface from a perfectly planar structure); allowing one or more drying fluids to contact the part of the wet ceramic greenware body in contact with the carrying structure; and allowing any liquid carrier exiting the wet ceramic greenware body to move away from the wet ceramic green ware body.

The carrying structure (carrier) consists of one or more carrying sheets in one embodiment. In another embodiment, the carrying structure comprises one or more carrying sheets and one or more support sheets. The one or more carrying sheets function to directly contact and support the wet ceramic greenware body during the liquid carrier removal process. Preferably only one carrying sheet is utilized. The one or more support structures function to support the carrying sheet in manner that the wet ceramic body retains its, or adjusts to the desired, shape, does not deform any further, during the liquid carrier removal process. The one or more support structures may perform one or more of the following additional functions: facilitate contact of the drying fluid with the wet ceramic greenware body or facilitating flow of liquid carrier away from the ceramic greenware body. Preferably, the carrying structure contains one support structure. Retains its shape, or does not deform, means that the wet ceramic greenware body does not change in shape, except to conform to the desired shape, and the portion of the wet ceramic body in contact with the carrying structure remains substantially planar or linear. Preferred carrying sheets are described in co-owned co-pending application titled "DRYING METHOD FOR CERAMIC GREENWARE" filed Jun. 22, 2011 Ser. No. 13/166,298 and filed in the PCT Jun. 22, 2011 application, number PCT/US/11/41410 both incorporated herein by reference. In the embodiment wherein the ceramic body does not contain a flat surface the carrier sheet can be shaped to support the shape of the ceramic body, that is has a cross sectional shape that matches the portion of the ceramic body in contact with the carrier sheet. The method of the invention for removing liquid carrier horn a wet ceramic greenware body involves placing the wet ceramic body on a carrier structure and placing the wet ceramic greenware body on the carrier structure in an oven under conditions such that the liquid carrier is substantially removed from the ceramic greenware body.

Any oven which assists in removing the liquid carrier from the wet ceramic body may be utilized in this method. Among preferred ovens useful in the invention are convection, infrared, microwave, radio frequency ovens and the like. In a more preferred embodiment a microwave oven is used. The wet ceramic body on a carrier structure may be placed in an oven for a sufficient time for the liquid carrier to be substantially removed from the ceramic greenware body and then removed from the oven. The wet ceramic body on a carrier structure can be manually placed in and removed from the oven. Alternatively the wet ceramic body on a carrier structure can be automatically introduced moved through and removed from an oven. Any automatic means for introducing a part into and removing a part from an oven may be utilized. Such means are well known in the art. In a preferred embodiment, the wet ceramic body on a carrier structure is placed on a conveyor and passed through one or more ovens on the conveyor. The residence time of a wet ceramic body on a carrier structure in the one or more ovens is chosen such that under the conditions of the one or more ovens substantially all of the liquid carrier is removed. The residence time is dependent upon all of the other conditions, the size of the wet ceramic greenware structure and the amount of liquid carrier to be removed. The temperature that the wet ceramic body on a carrier structure is exposed to in the one or more ovens is chosen to facilitate the removal of the liquid carrier from the wet ceramic body. Preferably the temperature is above the boiling point of the liquid carrier and below the softening temperature of material from which the carrier structure is fabricated and the temperature at which any of the ceramic precursors decompose. Preferably, the temperature that the wet ceramic body on, a carrier structure is exposed to in the oven is about 60° C. or greater, more preferably about 80° C. or greater and most preferably about 100° C. or greater. Preferably, the temperature that the wet ceramic body on a carrier structure is exposed to in the oven is about 120° C. or less and most preferably about 110° C. or less. The wet ceramic green ware body in the oven is preferably contacted with a drying fluid or a vacuum is applied to the oven to facilitate removal of liquid carrier from the wet ceramic body. Preferably, the wet ceramic greenware body is contacted with a drying fluid. In the embodiment, wherein the wet ceramic greenware body is shaped as the precursor to a flow through filter, wherein the flow passages in the wet ceramic greenware body have not been plugged at one end, it is preferable to flow the drying fluid through the flow passages of the wet ceramic greenware body. This is facilitated by directing the drying fluid to flow in the same direction as the flow passages are disposed on the carrier structure. Where the wet ceramic greenware body has a flat planar side and the wet ceramic greenware body is disposed on the carrier structure oil its flat planar side, the flow of the drying fluid is directed to flow through the flow passages in the wet ceramic greenware body. In the embodiment wherein the wet ceramic greenware body on the carrier structure is passed through one or more ovens on a conveyor, wet ceramic greenware bodies are disposed such that the direction of the flow passages are transverse to the direction of the conveyor and the drying fluid is passed in a direction transverse to the direction of the conveyor such that the drying fluid passes through the flow passages of the wet ceramic greenware bodies. If one face of the wet ceramic greenware body is disposed on the carrier structure, the drying fluid is directed up through the carrier structure, in the direction of the wet ceramic greenware body so that the drying fluid passes into and through the flow passages in the wet ceramic greenware body. The drying fluid can be any fluid which enhances the removal of liquid carrier from the vicinity of the wet ceramic greenware body. Preferably the drying fluid is a gas. Preferred gasses include air, oxygen, nitrogen, carbon dioxide, inert gasses and the like. Most preferably the drying fluid is air. After the drying fluid is contacted with the wet ceramic greenware body it is removed from the vicinity of the wet ceramic greenware body along with the liquid carrier entrained in the drying fluid. The flow of drying fluid is generated by any means which facilitates movement of a drying fluid such as a pump, a blower, and the like. The flow rate of the drying fluid is chosen to facilitate the removal of liquid carrier from the vicinity of the wet ceramic greenware body. Other important parameters for drying ceramic parts that are afforded utility by the carrier plate of the present invention are: two frequency regimes of microwave power (2.45 GHz and 91.5 MHz), varied reflected powers at those frequencies (from bout 0 to about 100%) relative humidity that can vary from about 0 to about 100%, residence time that can vary from about 0.01 to about 10 hours in periodic oven or belt driven continuous ovens, and a maximum part temperature that can range from about 50 to about 150° C.

After removal of the liquid carrier from the wet ceramic greenware body, the ceramic greenware body can be prepared for conversion to a ceramic body and converted to a ceramic body. The ceramic greenware body is exposed to conditions to burn out the binder and to form the ceramic structure. Processes to achieve this are well known in the art. The dry ceramic greenware parts are calcined by heating the dry ceramic greenware parts to temperatures at which organic additives and binders are volatilized or burned away. The parts are further heated to temperatures at which the ceramic particles fuse or sinter together or create new particulates that subsequently fuse together. Such methods are described by numerous patents and open literature references including U.S. Pat. Nos. 4,329,162; 4,471,792; 4,001,028; 4,162,285; 3,899,326; 4,786,542; 4,837,943 and 5,538,681 all incorporated herein by reference.

In a preferred embodiment the ceramic body prepared is acicular mullite. In this embodiment, the porous green shape may be heated under an atmosphere having fluorine and a temperature sufficient to form the mullite composition. Fluorine may be provided in the gaseous atmosphere from sources such as $SiF_4$, $AlF_3$, HF, $Na_2SiF_6$, NaF, and $NH_4F$. Preferably, the source of fluorine is $SiF_4$. The dried greenware may be heated under an atmosphere having a fluorine containing gas that is separately provided and to a temperature sufficient to form the mullite composition. "Separately provided" means that the fluorine containing gas is supplied not from the precursors in the mixture (for example, $AlF_3$), but from an external gas source pumped into the furnace heating the mixture. This gas preferably is a gas containing $SiF_4$. The ceramic part is preferably heated to a first temperature for a time sufficient to convert the precursor compounds in the porous body to fluorotopaz and then raised to a second temperature sufficient to form the mullite composition. The temperature may also be cycled between the first and second temperature to ensure complete mullite formation. The first temperature may be from about 500° C. to about 950° C. The second temperature may be any temperature suitable depending on variables such as the partial pressure of $SiF_4$. Generally, the second temperature is at least 1000° C. to at most 1700° C. Generally, during the heating to the first temperature, the atmosphere is inert or a vacuum until at least 500° C., which is when a separately provided fluorine containing gas desirably introduced. The untreated mullite body may be heated to a heat treatment temperature of at least 950° C. under a heat treatment atmosphere selected from the group consisting of air, water vapor, oxygen, an inert gas and mixtures thereof, for a time sufficient to form the mullite composition. Examples of inert gases include nitrogen and the noble gases (that is, He, Ar, Ne, Kr, Xe, and Rn). Preferably, the heat treatment atmosphere is an inert gas, air, water vapor or mixture thereof. More preferably, the heat treatment atmosphere is nitrogen, air or air containing water vapor. The time at the heat treatment temperature is a function of the heat treatment atmosphere and temperature selected. For example, a heat treatment in wet air (air saturated with water vapor at 40° C.) generally requires more than several hours to 48 hours at 1000° C. In contrast, ambient air, dry air or nitrogen (air having a relative humidity from 20 percent to 80 percent at room temperature) desirably is heated to 1400° C. for at least 2 hours. Generally, the time at the heat treatment temperature is at least about 0.5 hour and is dependent on the temperature used (that is, generally, the higher the temperature, the shorter the time may be). The time at the heat treatment temperature may be about 1 hour or more, preferably about 2 hours or more, more preferably about 4 hours or more, even more preferably about 6 hours or more, or most preferably at least about 8 hours to preferably at most about 4 days, more preferably at most about 3 days, even more preferably at most about 2.5 days and most preferably at most about 2 days.

The formation of the ceramic parts, as described above, involves placing the ceramic parts on a carrier having a surface suitable for supporting ceramic parts, for instance flat surface, and then placing the ceramic parts on the carrier in one or more furnaces sequentially, wherein the furnaces are adapted to perform the steps described above. This applies to ceramic greenware parts that have a planar surface that is of sufficient size to support the part on such planar surface. Alternatively the process applies to parts having at least one linear path which can be bowed, such as a part having a round, oval or irregular cross section. This process is especially useful for ceramic parts that have a uniform shape with planar sides which are capable of being bonded to a planar side of another ceramic part. Preferably the parts have a polygonal cross-sectional shape with all of the sides relatively planar. In a more preferred embodiment the ceramic greenware and ultimate ceramic parts have a square or rectangular shape. Preferably the ultimate ceramic parts are capable of being adhered to other parts using an in organic cement. A number of the parts can be adhered together to form a part of the desired size, generally of the desired cross-section. The individual greenware parts and the ultimate ceramic parts are often referred to as segments.

The greenware or ceramic parts are marked with at least one reference mark. The mark can be applied in any manner which allows the reference side (surface) to be identified throughout the rest of the process for forming a ceramic part. The reference mark can be applied manually or in an automatic manner. In a preferred manner the reference mark is unique to each part so that the parts can be tracked through the process. Preferably the unique reference mark is automatically stamped on one surface of the part. The reference mark is preferably applied after extrusion or drying.

After the drying step and application of the reference mark, which can be performed in any order, one or more of the linear paths or planar surfaces on the outer surface are examined for bow or flatness. Examined for flatness means that the surface is subjected to an operation to understand the shape of the part, such as how flat the surface is. Preferably a map of the surfaces of the ceramic body is created. The surfaces can be examined by any analytical technique that allows determination of the location of a number of points to define the shape of the part, for instance shape of a surface, or a linear path on the surface and/or preparation of a map of the shape of the part. The measurements and/or preparation of the maps may be performed manually or automatically. Alternatively a part without a flat surface can have a plurality of linear paths along the part examined in the same manner. Preferably the measurement data is fed to a computer program which can prepare a map of the shape of the body, such as one or more surfaces or linear paths of the part. Preferably all of the surfaces, such as planar surfaces, or a plurality of the linear paths are mapped. Where a plurality of linear paths are mapped, a sufficient number of linear paths are mapped to provide an understanding of where the linear path with the greatest bow having a convex shape is located. Software programs are commercially available that are capable of preparing such maps, for example Calypso available from CMM Products LLC. The data can be collected by any means that facilitates determination of the shape of a part and/or mapping of the shape of the parts, planar surfaces and/or the linear paths of the ceramic parts. For instance, the data can be collected using lasers, stylus, and the like. The data is collected and recorded at a sufficient number of points to accurately determine of the shape of the body, flatness of a surface or straightness of linear paths of the body and/or provide an accurate map of the shape of the body, each planar surface or straightness of linear paths of the body measured. In one embodiment the data is collected along a plurality of linear paths of the surface, preferably on each surface, of the body. Preferably, two sets of linear paths are used which are perpendicular to one another. Preferably each set of linear paths have lines that are parallel to one another. Data is collected along a sufficient number of linear paths to provide an accurate map of the shape of the body. Preferably data is collected along 3 or more linear paths in each direction. The upper limit on the number of linear paths in each direction is practicality; a preferred practical limit is defined by the size of the body and the distance between the lines. In one embodiment, a practical upper limit for the number of linear path is 10 or less. Preferably the distance between the linear paths is about 1 mm or greater and most preferably 2 mm or greater. Preferably the distance between the linear paths is about 10 mm or less and most preferably 5 mm or less. A number of points along the linear paths are recorded in order to facilitate determination of the how or flatness of a side (surface) or orientation of a linear path and/or mapping of the shape of the body, each surface and/or linear paths. The number and distance between the points are selected to facilitate determination of the shape of the body, flatness of a surface, orientation of the linear paths and/or accurate mapping of the shape of the body, surfaces and/or linear paths examined. Preferably the distance between the points on the linear paths is about 1 mm or greater and most preferably 2 mm or greater. Preferably the distance between the points on the linear paths is about 10 mm or less and most preferably 5 mm or less. Determination of the bow along a linear path or flatness of a surface and/or mapping can be performed after any or any combination of the steps in the formation of the ceramic parts. It is preferred to perform the mapping after the extrusion or drying step. It may be advantageous to also map the surface or side of the final product as a quality control step and to determine the success of the process of this invention.

Once the data is collected and/or maps of the shape of the body, the linear paths and/or flat surfaces are prepared, the data and/or the maps are examined for bow or flatness. Flatness is a determination of how close to a perfect plane the surface is. There are known processes for the determination of relative flatness including JISB0621-1984 as described in U.S. Pat. No. 7,879,428 relevant parts incorporated herein by reference. Flatness is generally measured by defining two parallel planes. One plane is defined by the innermost surface of a face of a honeycomb segment, toward the center of the honeycomb segment (least square fit plane of measured points) and the second plane is defined by the outermost surface of the same face of a honeycomb segment. The distance between the planes is known as the flatness. Lower numbers are considered better. As a practical matter the surface is mapped by taking several data points (e.g. x, y and z) and a least square fit plane is calculated mathematically based on the population of points. The planes are calculated to be parallel to one another and the orientation of the planes is based on the closest approximation orientation of the surface overall. The distance between the planes is the flatness. A perfectly flat surface has a flatness number of 0. Thus higher numbers represent greater deviation from a perfectly flat surface. It is desirable that the flatness of a surface be such that an effective bond can be formed between two surfaces of adjoining ceramic parts with the minimum thickness of adhesive. As a practical matter the flatness is preferably about 3.0 mm or less, more preferably about 2.5 or less and most preferably about 1.5 or less.

The data about or the maps of the shape of the body, for example each flat surface or linear path, measured are then examined. The bow of each measured surface or linear path is determined and the relative curvature of each surface or linear path is determined. Surfaces that are concave and convex are determined. Software is available to determine the bow of a surface (line) side based on the data collected or the map of the body, linear paths or surfaces. Examples of such software packages include entering the mapping data into a Visual Basic algorithm, visual examination, surface tables, and the like. In processing after extrusion and/or drying the linear paths and/or surfaces of one or more parts, preferably all of such parts, with a convex shape are identified. Further processing of the ceramic part is performed with the linear paths or surfaces of one or more parts, preferably all of the parts, having a convex shape placed directly on the carrier used in each of the remaining processing steps. Preferably the surfaces or linear paths of the part with a convex shape contacts the carrier at one point when placed on the carrier. It has been determined that during subsequent processing the number of parts with a convex shape is reduced where the convex linear path or surface is placed down, or on, the carrier surface. It has been determined that a significantly higher percentage of parts have their bow or flatness numbers reduced after final processing as compared to bow or flatness numbers after extrusion and or drying when the convex linear path or surface is placed down on the carrier before additional processing. Preferably the number of parts with unacceptable bow on a linear path or surface is reduced by 5 percent, more preferably 10 percent and most preferably 20 percent. Improvements in fatness, reduction in flatness number, result in thinner adhesive layers when the sides are bonded to other sides of other parts. Segmented ceramic objects with thinner adhesive layers exhibit lower back pressures and greater thermal robustness performance.

After completion of processing the ceramic parts, two or more of the parts may be adhered together using processes known in the art, such as disclosed in US Publication 2009/02390309; US Patent Publication 2008/02714212; U.S. Pat. No. 5,914,187; U.S. Pat. No. 6,669,751; U.S. Pat. No. 7,879,428; U.S. Pat. No. 7,396,576, all incorporated herein by reference. The adhesive cement utilized can be any adhesive known for this use as including those disclosed in the patents and patent publications cited, herein. In a preferred embodiment, ceramic parts comprised of at least two separate smaller ceramic parts (honeycombs) that have been adhered together by a cement comprised of inorganic fibers and a binding phase wherein the smaller parts and fibers are bonded together by the binding phase which is comprised of an amorphous silicate, aluminate or alumino-silicate ceramic binder. A method of forming a ceramic structure comprising contacting a first ceramic segment on at least one of its outer sides (surfaces) with a cement comprised of inorganic fibers having an average length between 100 micrometers to 1000 micrometers, a carrier fluid, a colloidal inorganic sol and in the absence of other inorganic particles, wherein the fibers have a solids loading of at least about 10% by volume of the total volume of the cement, mechanically contacting a second ceramic segment with the first ceramic segment such that the cement is interposed between the ceramic segments such that the ceramic segments are adhered; heating the adhered segments sufficiently to form amorphous ceramic bonding between the fibers of the cement and the ceramic segments to form the larger ceramic structure (array). After a segment or segments are contacted on their outer side with the cement, the segments are contacted with the cement interposed between the segments by any suitable method of doing so. Illustratively, the segments, if having a square cross-section, may be held in a template and the cement dispensed or injected in the gaps between the segments. The segments have the cement deposited the desired outer side, such as fitting a corner into an incline plane and building up from this first square in whatever pattern desired. The incline plane may, if desired have spacers also built in so that the first layer of segments has equidistant spacing resulting in more uniform cement layer thickness. Alternatively, the segments may be placed on a flat side and built up in a manner similar to brick masonry. Once the segments are adhered, the carrier fluid is removed by heating or any suitable method which may include just ambient evaporation or any other useful method such as those known in the art. The removal may also occur during the heating to form the amorphous binding of the fibers and the segments. Heating may also be used to remove any organic additives in the segments or cement. This heating may be any suitable such as those known in the at and may also occur during the heating to form the amorphous binding of the fibers and segments together. To create the amorphous binding phase, the heating should not be so high a temperature that crystallization occurs in the fiber (unless desired) or amorphous binding phase, sagging honeycomb structure or migration of the glass binding phase to an extent that is deleterious to the performance of the honeycomb structure. Typically, the temperature is at least about 600° C., to at most about 1200° C. After the parts are adhered together into an array the outside side of the segmented part may be shaped by any means known in the art, for example by grinding, cutting or sanding. Once shaped, the outside side is coated with a ceramic precursor to form a solid side (skin) and the part is exposed to conditions to render the coating a ceramic coating.

In a preferred embodiment the ceramic precursors and ceramic segments have a honeycomb structure in the plane perpendicular to the structure surface or linear path mapped and measured herein. Preferably the channels that pass through the structure are parallel to the mapped linear paths or surfaces. In another preferred embodiment, every other channel is plugged on each end and each channel is plugged on only one end. One class of ceramic parts for which this process is used are wall flow filters. Wall flow filters generally comprise structures having two opposing faces with channels or passages that extend from one face to the other face. In one embodiment, every other opening for the channels or passages are plugged on one end and the others are plugged on the other end. This means that for every channel all adjacent channels are plugged on the opposite end. The practical import of this structure is that when a fluid is introduced to one face of the filter it must flow into the open channels on that face and pass through the walls between the channels to the adjacent channels to reach and exit through the opposite face. Materials, such as solid particles that are larger than the pores in the walls are filtered out of the fluid and retained on the introduction side of the walls of the channels. In preferred embodiments the segment cross sectional area is from about 5 to 20 square inches and the length is from about 3 to about 20 inches.

The ceramic parts may be used in any applications in which it is useful to have ceramic honeycombs, such as, particulate filters (e.g., Diesel particulate filters), and flow channel catalyst branches (catalytic converted).

ILLUSTRATIVE EMBODIMENTS OF THE INVENTION

The following examples are provided to illustrate the invention, but are not intended to limit the scope thereof. All parts and percentages are by weight unless otherwise indicated.

In order to quantify the dimensional characteristics of acicular mullite segments, a six-point fixture system is constructed to consistently support a 3.2 in×3.2 in×12.5 in segment as shown in FIG. 1. Three posts 17 (A datum) support the bottom of the segment 16, two posts (B datum) 20 and clips 22 support the rear side 11 and one post (C datum) 21 constrains the front face 15 to establish a starting position. FIG. 1 shows a Zeiss coordinate measuring machine (CMM) 18 having a stylus 19 for measuring the side (surface) of the segments.

Figure 2:
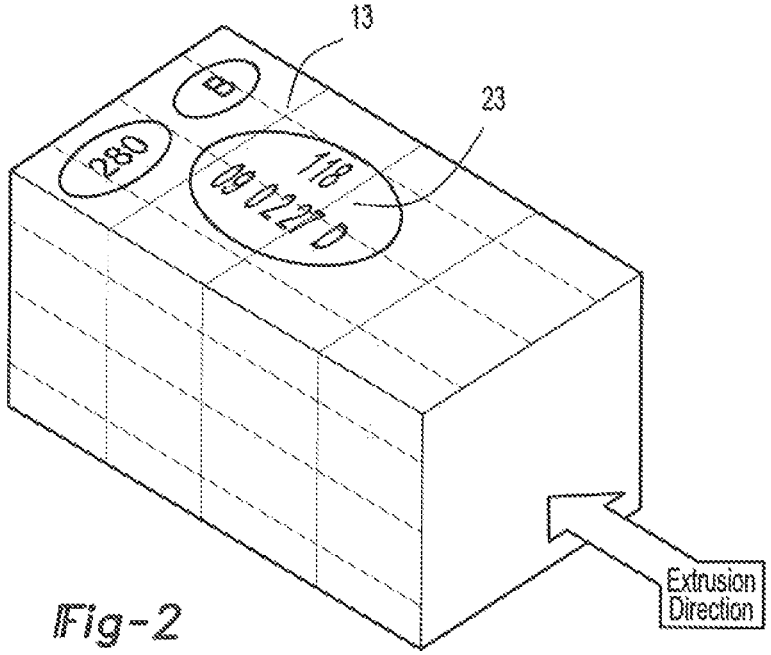
FIG. 2 shows a segment with reference markings.
Figure 3:
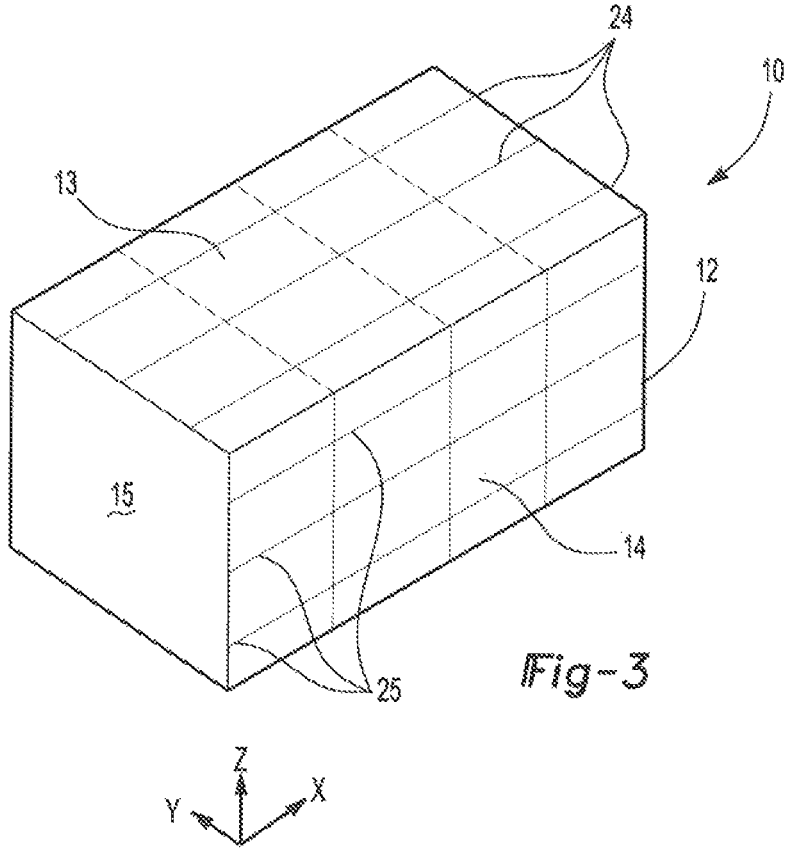
FIG. 3 shows an example of the lines along which segments surfaces are measured.
Figure 6:
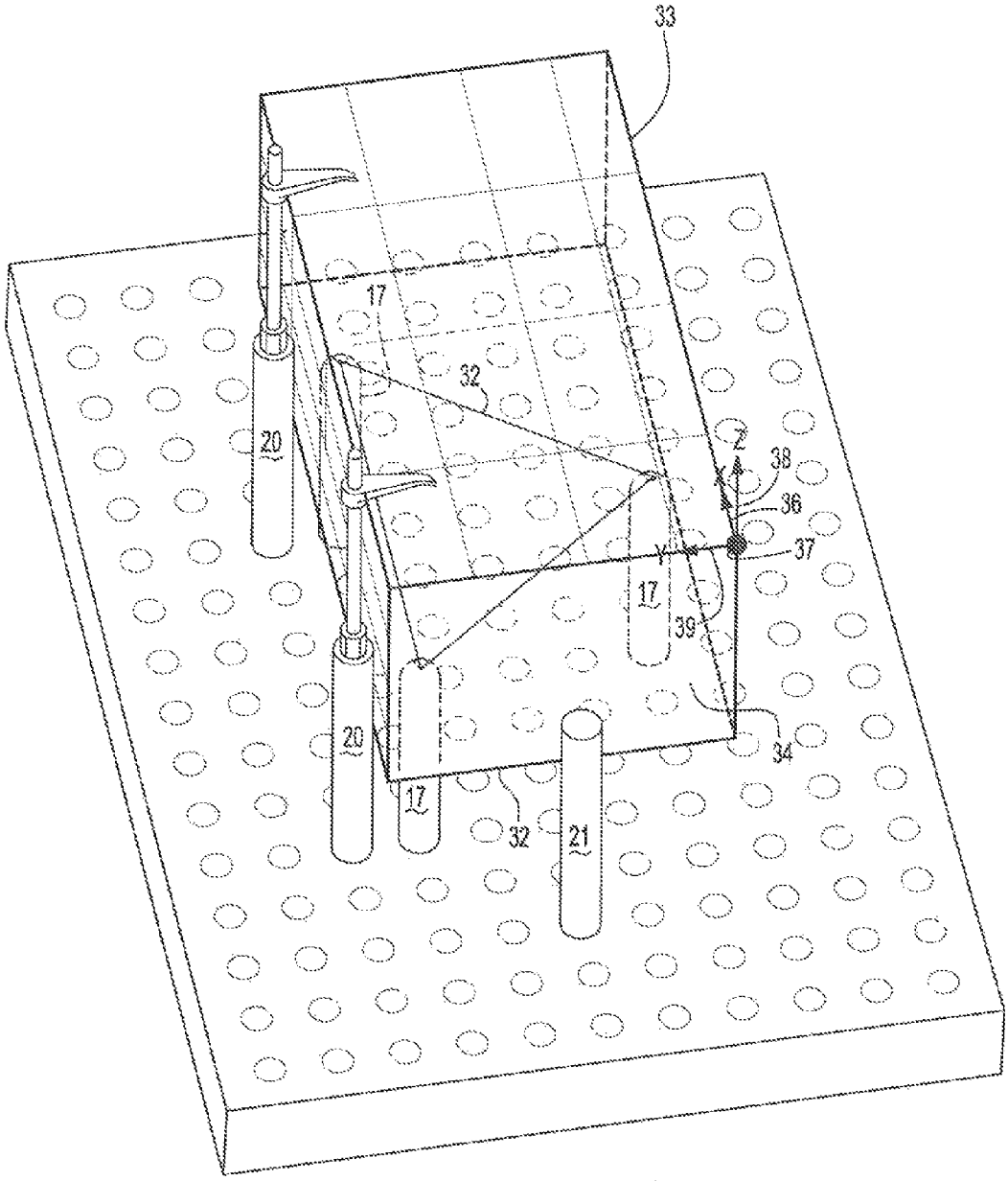
FIG. 6 illustrates how the fixed coordinate system is defined using the fixture system used in the examples.

Upon completion of extrusion and drying, the top side (surface) 13 of the extrudate is marked 23 to designate the specific orientation of the part 10 as shown in FIG. 2. The orientation of the text further denotes specifics of the other sides and faces respectively. For example, the left hand end is designated as the front face 15 whereas the right hand end was designated as the rear face 12. The bottom side of a segment 16 is first placed on the three lower posts 17 comprising the A datum plane; next, the back side 11 of the segment is then moved until the rear two posts 20 comprising the B datum plane constraining any further lateral motion. The segment 10 is then clipped in place, using clips 22, once the front face 15 contacted the front post 21 comprising the C datum plane whereby any forward motion is therefore constrained. Next, a contact stylus 19 is secured to a Zeiss Coordinate Measuring Machine (CMM) 18 and a custom program is executed to perform three axial scans 24 along the length of each segment side and three transverse scans 25 are performed at the front, middle and end of each side respectively as shown in FIG. 3. Transient axial scan data (x,y,z) is recorded every 5 mm along the segment side from a starting point of 12 mm and an end point of 292 mm respectively whereas transient transverse scan data is recorded every 1 nm along the segment side. The transient axial scan data is generated using a fixed coordinate system. In essence, three planes are determined which are perpendicular to each other and define flat planes against which the surface dimensions of ceramic parts are reported. FIG. 6 illustrates how the fixed coordinate system is defined using the fixture system of the invention. In particular the top points of posts 17 define the primary Datum plane 32 (Datum A). In conjunction with the primary Datum plane posts 20 define the secondary Datum plane 33 (Datum B). In conjunction with the primary Datum plane and the secondary Datum plane and post 21 the tertiary Datum plane 34 (Datum C) is defined. When a stylus system connected to a processor is utilized to perform the measurements, the stylus touches the contact points of the posts, records these points in space thus defining the three reference planes. The intersection point of the three planes is the reference point 39 from which the x, y and z coordinates are measured, see arrows 36 (*x*), 37 (*y*) and 38 (*z*). The transient position of the ceramic segments is measured with reference to these planes and the reference points. Upon completion of CMM scanning, the bow along the length of the segment is calculated front each transient axial scan using the following protocol: Transient (x,y,z) data are brought into a tab of a Microsoft Excel spreadsheet and an additional "XACt^2" column of data is incorporated. Next, within the "Tools/Data Analysis/Regression" menu, a $2^{nd}$ order polynomial regression is performed as follows: Input Y range (1 column of data): YACT for Front & Back sides; ZACT for Top and Bottom sides Input X range (2 columns of data): XACT and XACT^2; Click "OK.".

Determine bow shape from X Variable 2 coefficient:

X Variable 2>0 . . . CONVEX: X Variable 2<0 . . . CONCAVE. NOTE: for a twice differentiable function $f$, if the second derivative, $f''(x)$, is positive, then the curve is convex; if $f''(x)$ is negative, then the curve is concave.

Determine "reference line" end points:

CONVEX Condition:

Define $XACT_{max}$ point within 157≤XACT≤292 that maximizes response;

Define $XACT_{min}$ point that maximizes slope, m;

$$m=[Y(X)-Y_{XACT,MAX}]/[X_{ACTMAX}-X]:$$

CONCAVE Condition:

Define $XACT_{MAX}$ point within 157≤ACT≤292 that minimizes response;

Define $XACT_{MIN}$ point that minimizes slope, m;

$$m=[Y(X)-Y_{XACT,MAX}]/[X_{ACTMAX}-X]$$

Determine "side (surface) table" reference line equation $$Y_{REF}=m*x+B$$

CONVEX Condition:

$$Y_{REF}Y@X_{ACTMIN}-m\cdot(X-X_{ACTMIN})$$

CONCAVE Condition:

$$Y_{REF}=m\cdot(X_{ACTMIN}-X)+Y@X_{ACTMIN}$$

Calculate axial bow from following set of equations;

$$\text{Axial Bow}=\text{MIN}[Y-Y_{REF}] \quad \text{CONVEX condition:}$$

$$\text{Axial Bow}=\text{MAX}[Y-Y_{REF}]. \quad \text{CONCAVE condition:}$$

Figure 4:
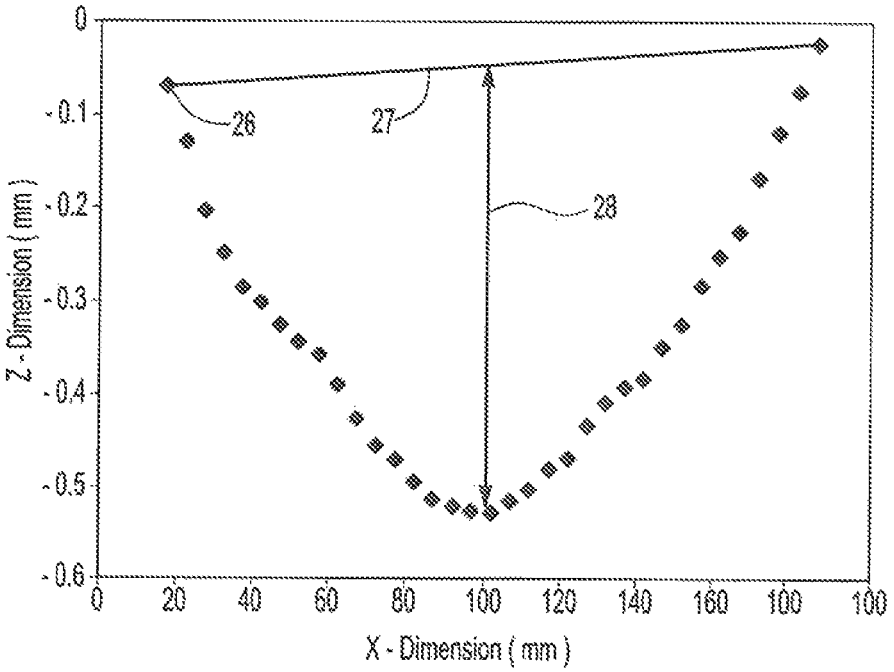
FIG. 4 shows a plot of the measurement data for a surface which shows the bow of a surface of a ceramic part.

A representative example of this calculation method with overlayed CMM data for the top side (surface) of an ACM segment is shown in FIG. 4. Shown is the end point 26, side (surface) table reference line 27 and the axial bow 28. Mean axial bow, MAB is then computed for each side of a segment from an average of the three axial bow calculations as shown in equation 1.

$$MAB=\frac{\sum_{1}^{3} AxialBow_a}{3}. \tag{1}$$

Approximately 200 32×3.2×12.5 inch greenware segments are subjected to CMM dimensional measurements. Of the segments provided, 50 exhibit ABS(MAB)>1 on at least one side of the segment. Moreover, the nature of the bow as a function of segment side is further known to be either concave or convex from the previously described measurement algorithm. Thus, the 50 "quarantined" segments are then subjected to carefully controlled calcination or debindering experiments to understand the effect of part orientation on post-calcination dimensional measurements.

Figure 5:
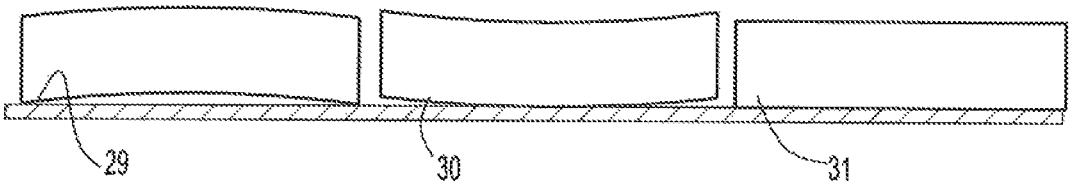
FIG. 5 shows different orientations of the segments with a bow on a carrier.

Next, the quarantined segments are split into three groups for special placement onto the side (surface of the calcination racks as illustrated in FIG. 5. Three orientations are utilized: concave side (surface) down, 29, convex side (surface) down, 30, and bow orthogonal to gravity 31. The segments are then calcined in accordance with the following procedure:

Step I: heating step from room temperature to 200° C. with 25K/h, with slow heating in order to avoid strong thermal gradients inside, the parts.

Step II: heating step from 200° C. to 350° C. with 7 K/h, very slow heating because the critical debindering phase occur which removes organic components; this exothermal reaction will cause stronger heating of the part center. Low thermal gradients will avoid crack formation. A nitrogen atmosphere with 3% oxygen at maximum flow will be applied during Step I and II.

Step III: heating steps from 350° C. to 500° C. with 25K/h; from 500° C. to 600° C. with 30K/h and from 600° C. to 1080° C. with 35 K/h. Completion of debindering phase-stopping the nitrogen and oxygen flow due to thermal treatment inducing first solid chemical reaction of raw materials which includes an increase in pore sizes and in rain sizes.

Step IV: hold at final calcination temperature for 2 hours, to increase pore sizes and rain sizes.

Step V: cooling step from 1080° C. to room temperature applying several negative ramp rates. Slow controlled cooling of the parts will avoid strong thermal gradients and finally crack formation. Upon completion of calcination, the segments are subjected to CMM dimensional measurements. The before and after MAB results of the calcined segments are compiled in Table 1.

TABLE 1

| Segment | Concave side down | | Convex side down | | Bow orthogonal to gravity | |
|---|---|---|---|---|---|---|
| No. | Greenware | Calcined | Greenware | Calcined | Greenware | Calcined |
| 1 | −1.1377 | . | 1.3653 | 1.0085 | −1.04 | −1.2359 |
| 2 | −1.0768 | −1.2095 | 1.5681 | 1.2103 | −1.0371 | −1.1596 |
| 3 | −1.0994 | −1.0667 | 1.0973 | 0.8767 | −0.7908 | . |
| 4 | −1.1269 | . | 1.4997 | 1.2646 | −1.1361 | −1.354 |
| 5 | −1.1015 | . | 1.4523 | . | −1.0338 | . |
| 6 | −1.0557 | . | 1.3593 | 1.0172 | −1.0427 | −1.0329 |
| 7 | −1.0247 | −0.406 | 1.1409 | 0.8157 | −1.0247 | −1.045 |
| 8 | −1.2041 | −1.2752 | 1.2826 | 1.0491 | −1.0657 | −1.2189 |
| 9 | −1.1383 | −1.3279 | 1.6146 | 1.3954 | −1.0326 | −0.0877 |
| 10 | −1.1612 | 0.0213 | 1.4764 | 1.1614 | −1.1038 | −1.286 |
| 11 | −1.0806 | −1.1884 | 1.4022 | 1.064 | −1.0813 | −0.8913 |
| 12 | −1.2145 | . | 1.3256 | 0.994 | −1.0267 | −0.1588 |
| 13 | −1.2205 | −1.4144 | 1.2365 | 0.7891 | −1.0064 | −0.3357 |
| 14 | −1.1556 | −1.424 | 1.4012 | 1.0465 | −0.7648 | −0.8116 |
| 15 | −1.075 | −1.3357 | 1.1782 | 0.842 | −1.017 | −1.4148 |
| 16 | −1.2162 | −1.3504 | 1.2585 | 0.9417 | −1.0178 | . |
| 17 | −1.1361 | −1.3217 | 1.0757 | 0.792 | −1.04 | −1.2359 |
| MEAN | −1.13 | −1.10 | 1.34 | 1.02 | −1.01 | −0.92 |

The MAB of 3.2×3.2×12.5" ACM greenware segments decreased approximately 25 percent when the concave side (surface) is placed down on the side (surface) of the calcination rack. The degree of flatness improvement from greenware to post-calcination in 3 2×3.2×12.5" ACM segments with the convex side (surface) placed down on the calcination rack is compiled in Table 2.

TABLE 2

| Segment | Convex side (surface) down | |
|---|---|---|
| No. | Greenware | Calcined |
| 1 | 2.0619 | 1.6271 |
| 2 | 2.3344 | 1.7955 |
| 3 | 1.8724 | 1.1485 |
| 4 | 2.2791 | 1.921 |
| 5 | 2.2733 | |
| 6 | 2.1551 | 2.5923 |
| 7 | 1.8206 | 2.1067 |
| 8 | 2.145 | 1.7976 |
| 9 | 2.2774 | 1.9965 |
| 10 | 2.0806 | 1.7198 |
| 11 | 2.0622 | 1.6808 |
| 12 | 2.1209 | 1.7028 |
| 13 | 1.9672 | 1.4268 |
| 14 | 2.092 | 1.5931 |
| 15 | 1.6074 | 1.22 |
| 16 | 1.823 | 1.3561 |
| 17 | 2.0063 | 1.3678 |
| MEAN | 2.06 | 1.69 |

Parts by weight as used herein refers to 100 parts by weight of the composition specifically referred to. In most cases, this refers to the adhesive composition of this invention) The preferred embodiment of the present invention has been disclosed. A person of ordinary skill in the art would realize however, that certain modifications would come within the teachings of this invention. Therefore, the following claims should be studied to determine the true scope and content of the invention.

Any numerical values recited in the above application include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints. Parts by weight as used herein refers to compositions containing 100 parts by weight. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

What is claimed is:

1. A method comprising:

a) determining a bow in an extrusion direction of one or more linear paths on an outer surfaces or outer surfaces of an extruded greenware part so that maximum extrusion direction bow of the one or more linear paths or outer surfaces of the extruded greenware part may be determined;

b) identifying the one or more linear paths on the outer surface or the outer surfaces having maximum convex bow;

c) placing the extruded greenware part on a carrier with the one or more linear paths on the outer surface or the outer surfaces having the maximum convex bow in contact with the carrier; and d) processing the extruded greenware part while disposed on the carrier with the one or more linear paths on the outer surface or the outer surfaces having a convex shape on the carrier, such that the bow is reduced as a result of a process of converting the extruded greenware part to a ceramic part;

wherein the bow is reduced by about 10% or greater.

2. The method according to claim 1, wherein the extruded greenware part is adapted to prepare the ceramic part comprising one or more of alumina, silica zirconia, silicon carbide, silicon nitride and aluminum nitride, silicon oxynitride and silicon carbonitride, cordierite, beta spodumene, aluminum titanate, strontium aluminum silicates, lithium aluminum silicates, composites of mullite and cordierite, or combination thereof.

3. A method comprising:

a) determining a bow in an extrusion direction of one or more linear paths on an outer surfaces or outer surfaces of an extruded greenware part so that maximum extrusion direction bow of the one or more linear paths or outer surfaces of the extruded greenware part may be determined;

b) identifying the one or more linear paths on the outer surface or the outer surfaces having maximum convex bow;

c) placing the extruded greenware part on a carrier with the one or more linear paths on the outer surface or the outer surfaces having the maximum convex bow in contact with the carrier; and d) processing the extruded greenware part while disposed on the carrier with the one or more linear paths on the outer surface or the outer surfaces having a convex shape on the carrier, such that the bow is reduced as a result of a process of converting the extruded greenware part to a ceramic part;

wherein the extruded greenware part is adapted to prepare the ceramic part comprising one or more of alumina, silica zirconia, silicon carbide, silicon nitride and aluminum nitride, silicon oxynitride and silicon carbonitride, mullite, cordierite, beta spodumene, aluminum titanate, strontium aluminum silicates, lithium aluminum silicates, composites of mullite and cordierite, or combination thereof.

4. The method according to claim 3, wherein the carrier is a plate, rack or conveyor and is adapted to carry the extruded greenware part during the process operations to form the extruded greenware part into the ceramic part.

5. The method according to claim 3, wherein the extruded greenware part has one or more flat surfaces and the one or more flat surfaces of the ceramic part are cemented to one or more other ceramic parts with flat surfaces.

6. The method according to claim 5, wherein the ceramic part has a plurality of flat surfaces.

7. The method according to claim 6, wherein a cross sectional shape of the ceramic part is a polygon having a plurality of flat surfaces.

8. The method according to claim 7, wherein the cross sectional shape of the ceramic part is a square or a rectangle.

9. The method according to claim 3, wherein a shape of the extruded greenware part is mapped and results of the mapping are used to calculate the bow of one or more outer surfaces or one or more linear paths of the extruded greenware part.

10. The method according to claim 3, wherein a sufficient number of data points are collected to accurately determine the bow of one or more outer surfaces or one or more linear paths of the extruded greenware part.

11. The method according to claim 3, wherein the extruded greenware part is adapted to prepare the ceramic part comprising one or more of silicon carbide, cordierite, mullite composites, and mullite.

12. The method according to claim 11, wherein the extruded greenware part is adapted to prepare the ceramic part comprising mullite.

13. The method according to claim 12, wherein the extruded green are part is converted to the ceramic part comprising mullite by exposing it to a drying, a calcining, and a mullitization step.

14. The method according to claim 3, wherein the bow of one or more outer surfaces or one or more linear paths of the ceramic part formed is about 3.0 mm or less.

15. The method according to claim 3, wherein an acceptance rate of production of a plurality of ceramic parts is increased by 10 percent.

16. The method according to claim 3, wherein one of the outer surfaces of the extruded greenware part is marked with a reference marking to facilitate identification of the outer surfaces.

17. The method according to claim 5, wherein a flatness of all of the flat sides is determined.

18. The method according to claim 17, wherein all of the resulting flat sides exhibit a flatness of about 3.0 mm or less.

19. The method according to claim 3, wherein the ceramic part is a honeycomb filter.

20. A method comprising:

a) determining a flatness of an extruded greenware part having one or more flat sides;

b) identifying a side with a convex shape;

c) placing the extruded greenware part on a carrier with the side having the convex shape on the carrier; and d) converting the extruded greenware part to a ceramic part while disposed on the carrier with the side having the convex shape on the carrier;

wherein a resulting flatness of at least one of the one or more flat sides is such that its surface can be bonded to a surface of another extruded greenware part in an efficient manner;

wherein the extruded greenware part is adapted to prepare the ceramic part comprising one or more of alumina, silica zirconia, silicon carbide, silicon nitride and aluminum nitride, silicon oxynitride and silicon carbonitride, mullite, cordierite, beta spodumene, aluminum titanate, strontium aluminum silicates, lithium aluminum silicates, composites of mullite and cordierite, or combination thereof.

* * * * *